US007077341B2

(12) United States Patent
Kwak

(10) Patent No.: US 7,077,341 B2
(45) Date of Patent: Jul. 18, 2006

(54) FUEL INJECTION DEVICE

(76) Inventor: Ssang-Sin Kwak, #205-2005 Jueun-Cheongseol Apartment, San 36-1, Jinsa-ri, Kongdo-eup, Anseong-si, Kyunggi-do (KR) 456-715

( * ) Notice: Subject to any disclaimer, the term of this patent is extended or adjusted under 35 U.S.C. 154(b) by 164 days.

(21) Appl. No.: 10/897,794

(22) Filed: Jul. 23, 2004

(65) Prior Publication Data

US 2005/0035223 A1 Feb. 17, 2005

(30) Foreign Application Priority Data

Aug. 14, 2003 (KR) ..... 10-2003-0056335

(51) Int. Cl.
*F02M 61/00* (2006.01)
*F02M 59/00* (2006.01)
*F02M 47/02* (2006.01)
*B05B 1/30* (2006.01)

(52) U.S. Cl. ..... 239/533.12; 239/533.2; 239/533.14; 239/88; 239/585.5

(58) Field of Classification Search ..... 239/533.12, 239/533.2, 533.14, 88, 90, 91, 92, 533.3, 239/533.11, 585.1, 585.3, 585.4, 585.5
See application file for complete search history.

(56) References Cited

U.S. PATENT DOCUMENTS 4,540,126 A * 9/1985 Yoneda et al. ..... 239/533.4
5,163,621 A * 11/1992 Kato et al. ..... 239/533.12
5,244,154 A * 9/1993 Buchholz et al. ..... 239/590.3
5,570,841 A * 11/1996 Pace et al. ..... 239/585.1
5,890,660 A * 4/1999 Stevens ..... 239/533.3
6,279,844 B1 * 8/2001 Shen et al. ..... 239/585.4

* cited by examiner

*Primary Examiner*—Davis Hwu
(74) *Attorney, Agent, or Firm*—GWiPS

(57) ABSTRACT

A new fuel injecting device is comprised of a nozzle body formed a fuel supply hole in the center top end for injecting the fuel to a combustion chamber, a plurality of the spiral grooves and the edge grooves formed vertically and alternately on the outer peripheral surface of the lower portion. Each edge groove is positioned between two adjacent spiral grooves for supplying the fuel through the fuel supply hole. Each spiral groove and edge groove are formed a flow sectional area reduced gradually from inlet to outlet. A cylindrical shaped nozzle case is openable upward or downward and adapted to accommodate the nozzle body at a lower portion and the injector at an upper portion. The injector is positioned on the nozzle body and the injection hole is tightly secured onto the fuel supply hole of the nozzle body.

1 Claim, 4 Drawing Sheets

FUEL INJECTION DEVICE

BACKGROUND OF THE INVENTION

1. Field of the Invention

The present invention relates to a fuel injection device, more particularly, the present fuel injecting device is capable to atomize the fuel particles to inject to a combustion chamber to improve the efficiency of fuel combustion per unit volume of the fuel, so that the output power and gas mileage can be highly enhanced, and the un-burned gas is reduced to decrease the pollutant.

2. Related Prior Art

Generally, an internal combustion engine is used to mix up air with fuel at an appropriate ratio by using an injector, to inject the fuel into a combustion chamber, to make the fuel exploded into the combustion chamber to allow a piston to be pushed, and thus to generate power therefrom.

In the case where the fuel is not evenly injected into the combustion chamber during the injection process, however, it is not completely burnt, which makes the combustion efficiency fall down. Also, this generates pollutants that cause air pollution.

To overcome these problems, thus, there have been proposed a fuel injection device having a plurality of injectors that serve to inject fuel at high pressure such that the fuel can be spread largely.

Since most of the conventional fuel injection devices have been developed only to inject the fuel at high pressure, however, there is a limitation in making the fuel particles fine, which makes it difficult to improve the combustion efficiency.

SUMMARY OF THE INVENTION

Accordingly, the present inventor has been made to solve the above-described problems occurring in the prior art, and it is an object of the present invention to provide a fuel injection device that allows fuel injected from an injector to be passed through a plurality of spiral grooves and a plurality of edge grooves that are vertically alternately formed on an outer peripheral surface of a nozzle body, thereby causing fuel particles to collide against one another with a result of producing fine fuel particles, and that allows a space sectional area through which the fuel is passed to be gradually reduced, thereby allowing the flow rate of fuel to be increased and also making the fuel evenly injected into a combustion chamber by generating vortex in the flowing fuel, thus to enhance the combustion efficiency and also reduce the generation of unburnt gas.

To accomplish the above object, according to the present invention, there is provided a fuel injection device comprising: a nozzle body having a fuel supply hole formed in the middle of the top end thereof, through which the fuel injected from an injection hole of an injector is supplied to a combustion chamber, and a plurality of groups of spiral grooves and a plurality of edge grooves vertically alternately formed on the outer peripheral surface of the lower portion thereof in such a manner that each edge groove is positioned between two adjacent ones of the plural spiral groove groups, for flowing the fuel supplied through the fuel supply hole therethrough, each of the spiral grooves and the edge grooves being formed in such a manner as to have a flow sectional area gradually reduced from an inlet to an outlet; and a cylindrical shaped nozzle casing that is upwardly and downwardly opened and adapted to accommodate the nozzle body at a lower portion thereof and the injector at an upper portion thereof, in such a manner that the injector is positioned on the nozzle body and the injection hole of the injector is tightly secured onto the fuel supply hole of the nozzle body.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Now, an explanation on the preferred embodiments of the present invention will be in detail given with reference to attached drawings.

Figure 1:
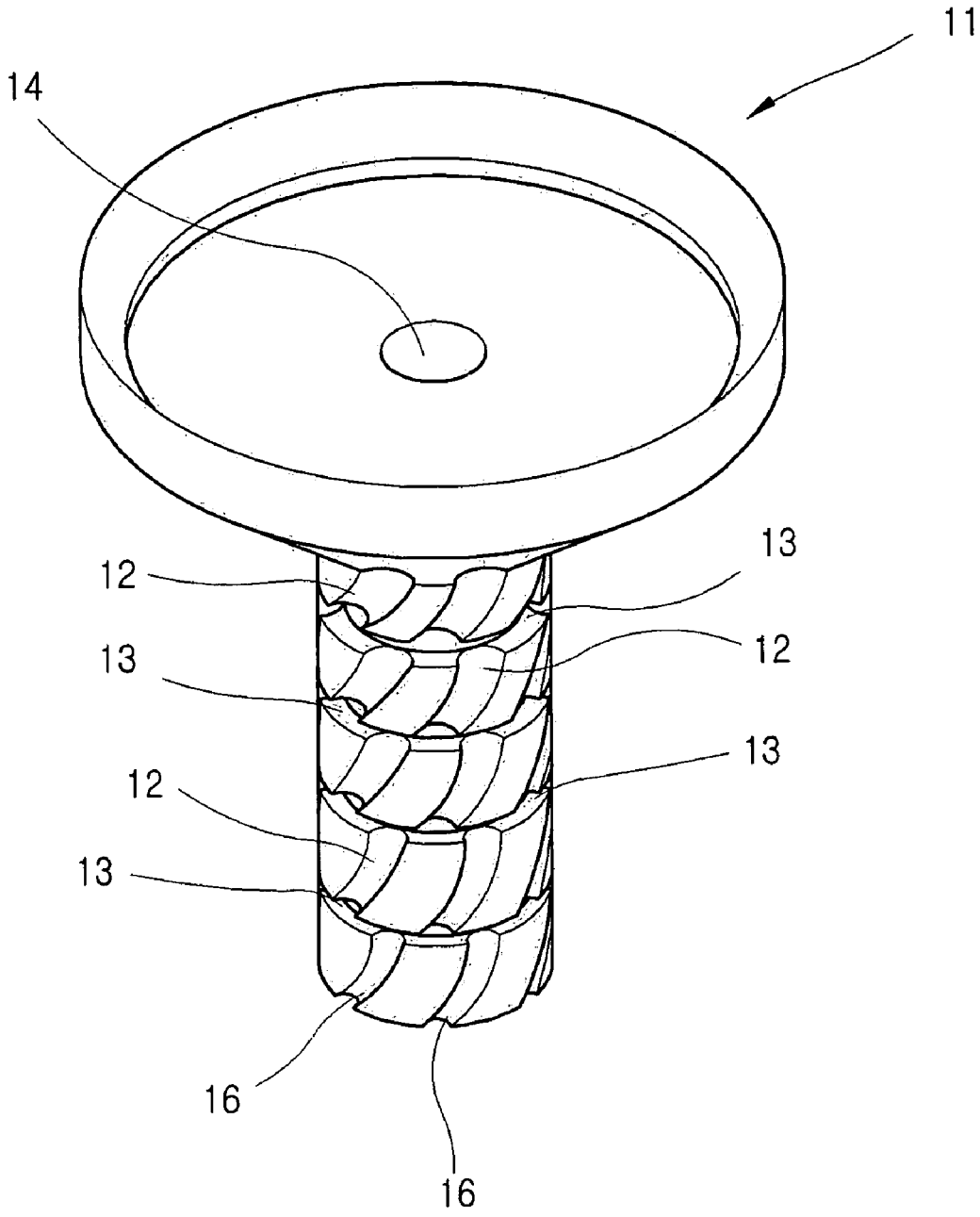
FIG. 1 is a perspective view of a nozzle body of a fuel injection device according to the present invention.
Figure 2:
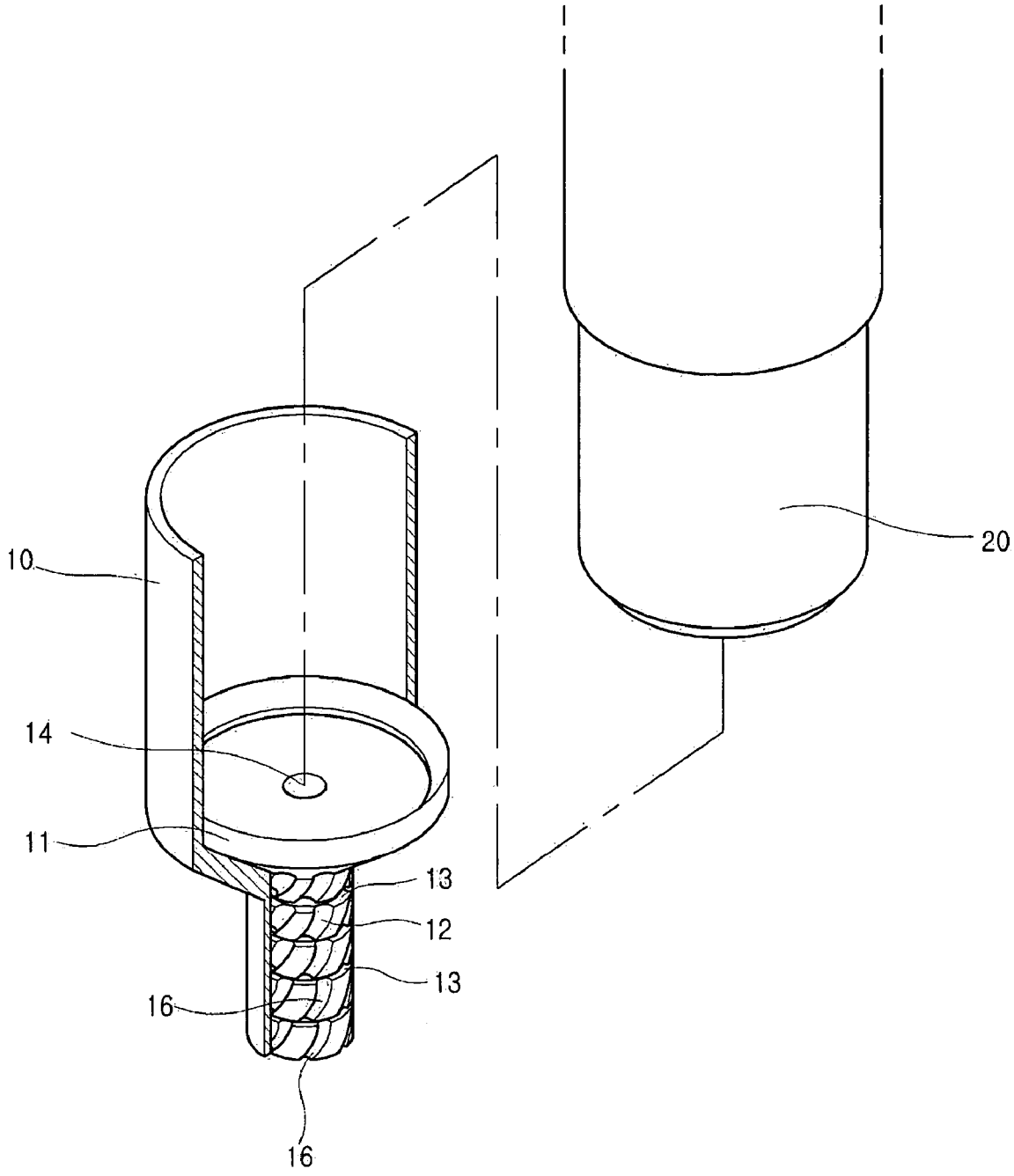
FIG. 2 is a perspective view showing a case where the nozzle body is inserted into a nozzle casing and an injector is assembled with the nozzle casing.
Figure 3:
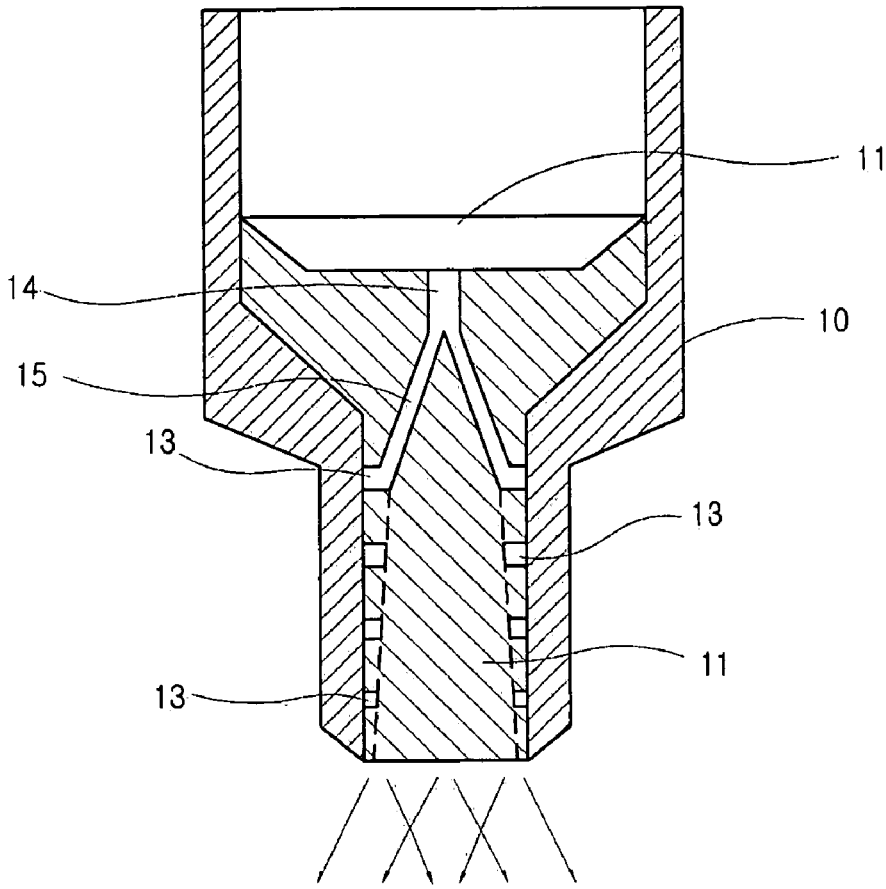
FIG. 3 is a sectional view showing a case where the nozzle body is inserted into the nozzle casing.
Figure 4:
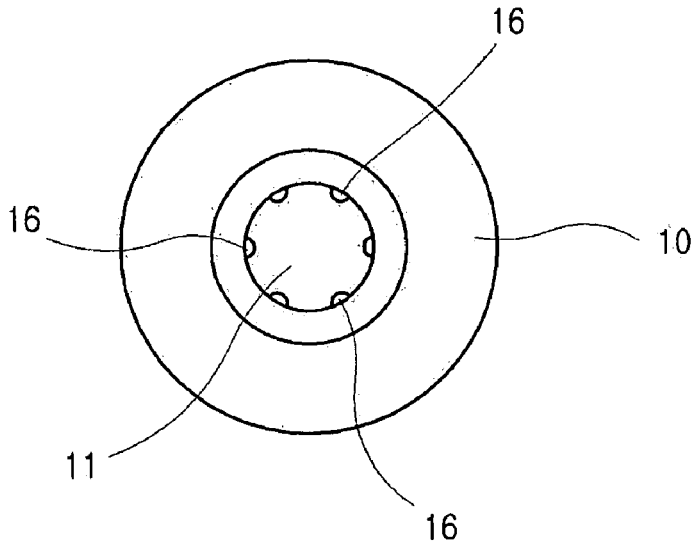
FIG. 4 is a bottom view of FIG. 3.

FIG. 1 is a perspective view of a nozzle body of a fuel injection device according to the present invention, FIG. 2 is a perspective view showing a case where the nozzle body is inserted into a nozzle casing and an injector is assembled with the nozzle casing, FIG. 3 is a sectional view showing a case where the nozzle body is inserted into the nozzle casing, and FIG. 4 is a bottom view of FIG. 3.

As shown in FIGS. 1 to 4, a fuel injection device according to the present invention includes a nozzle body 11 that has a fuel supply hole 14 formed in the middle of the top end thereof, through which the fuel injected from an injection hole 21 of an injector 20 is supplied to a combustion chamber. The fuel supply hole 14 is connected to a connection pipe 15 that is adapted to connect the fuel supply hole 14 to a plurality of spiral grooves 12, such that the fuel supplied to the fuel supply hole 14 flows to the plurality of spiral grooves 12.

The nozzle body 11 is provided with a plurality of groups of spiral grooves 12 that are formed radially on the outer peripheral surface of the lower portion thereof and a plurality of edge grooves 13 that each is formed between two adjacent ones of the plural spiral groove groups.

The fuel that is supplied from the connection pipe 15 is passed through the spiral grooves 12 and the edge grooves 13. In this case, each of the spiral grooves 12 and the edge grooves 13 is formed in such a manner as to have a flow sectional area gradually reduced from an inlet to an outlet thereof. Also, the plurality groups of edge grooves 13 and the edge grooves 3 are formed to allow the fuel to be passed through in a zigzag pattern, and the fuel is finally injected through a plurality of spiral grooves 16 that are positioned at the lowermost portion of the nozzle body 11 into a combustion chamber (not shown in the drawing).

Also, the fuel injection device according to the present invention includes a cylindrical shaped nozzle casing 10 that is upwardly and downwardly opened and is adapted to accommodate the nozzle body 11 at the lower portion thereof and with the injector 20 at the upper portion thereof, in such a manner that the injector 20 is positioned on the nozzle body 11 and the injection hole 21 of the injector 20 is tightly secured onto the fuel supply hole 14 of the nozzle body 11. That is, the inner peripheral surface of the nozzle casing 10 is coupled with the outer peripheral surfaces of the nozzle body 11 and the injector 20.

Next, an explanation on a way of injecting the fuel by using the fuel injection device as constructed above is given.

Figure 5:
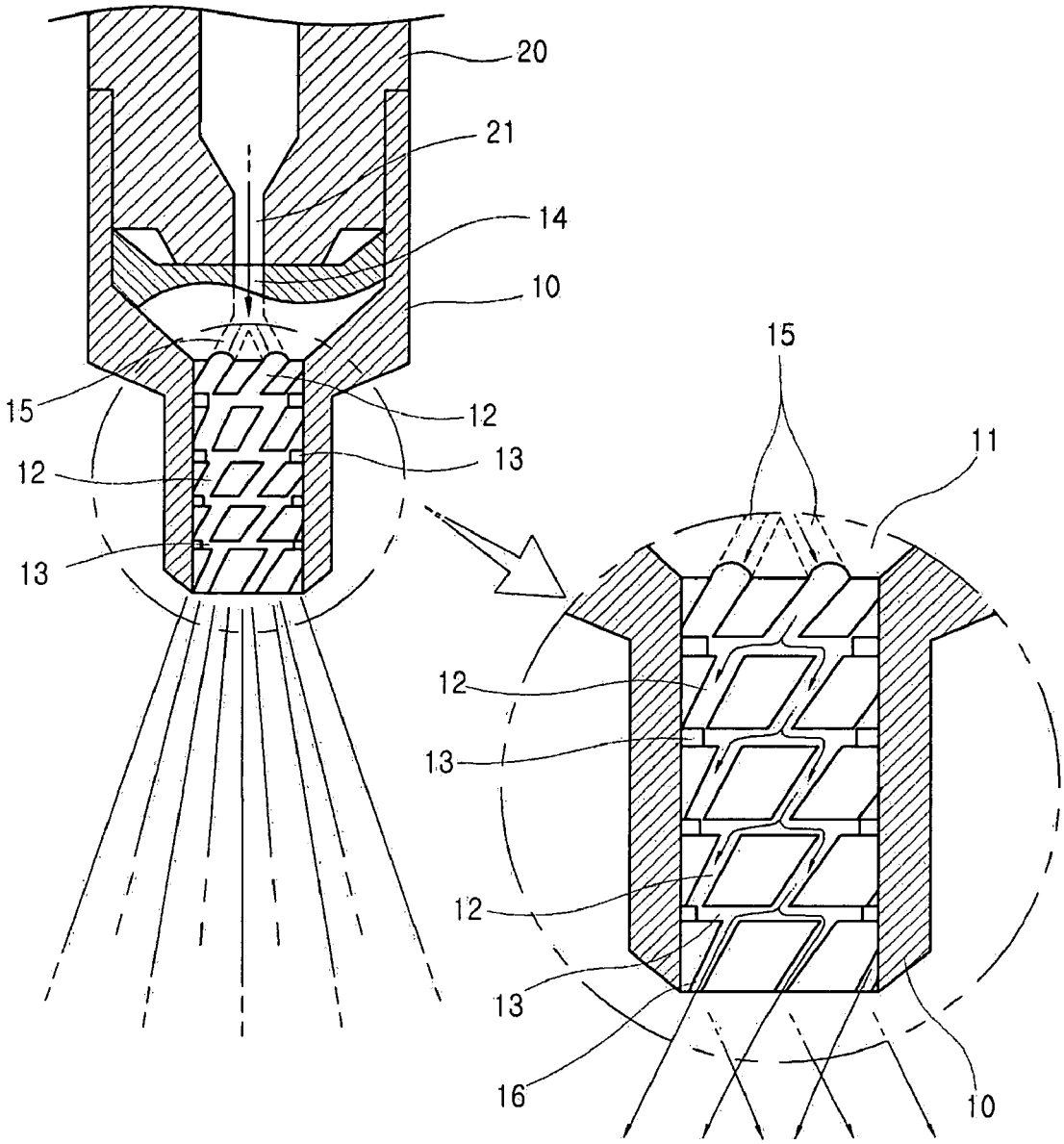
FIG. 5 is a partly sectional view of FIG. 2.

FIG. 5 is a partly sectional view showing a case where the nozzle body 11 is inserted into the nozzle casing 10 and the injector 20 is assembled with the nozzle casing 10.

As shown, the nozzle body 11 is inserted into the nozzle casing 10, and the injection hole 21 of the injector 20 is fixedly assembled with the fuel supply hole 14 of the nozzle body 11 in such a manner as to communicate with the fuel supply hole 14.

Thus, the fuel is supplied to the fuel supply hole 14 of the nozzle body 11 through the injection hole 21 of the injector 20. The supplied fuel is distributed to the plurality of spiral grooves 12 through the connection pipe 15, and as the fuel is supplied to the plurality of spiral grooves 12 each having the flow sectional area reduced gradually toward the outlet direction, the flow rate of the fuel can be increased. In addition, the fuel flows spirally by the formation of the spiral grooves 12, thereby forming the vortex at the time of flowing, and also, as the fuel is passed through the spiral grooves 12 and the edge grooves 13 in a zigzag manner, the fuel particles collide against one another and become fine.

As a result, the fuel is evenly injected into the combustion chamber, which allows the combustion efficiency to be high and achieves a complete combustion result, while reducing the generation of unburnt gas.

As set forth in the foregoing, a fuel injection device according to the present invention makes the fuel that is injected from the injector passed through the plurality of spiral grooves and the plurality of edge grooves each having the flow section area gradually reduced toward the outlet thereof, such that as the fuel is passed through the gradually reduced areas of the grooves, it can flow at a substantially high speed and forms the vortex in the flowing, and the formation of the plurality of spiral grooves and the plurality of edge grooves causes the fuel particles to be fine. Thus, when the fuel is injected into the combustion chamber, it can be completely burnt, while suppressing the generation of unburnt gas. This ensures a high efficiency of combustion.

While the embodiment of the present invention relates to an internal combustion engine, it may be of course applied to combustion devices in general industrial fields and heating boiler combustion devices.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A fuel injection device comprising:

a nozzle body having a fuel supply hole formed in the middle of the top end thereof, through which the fuel injected from an injection hole of an injector is supplied to a combustion chamber, a plurality of groups of spiral grooves and a plurality of edge grooves vertically alternately formed on the outer peripheral surface of the lower portion thereof in such a manner that each edge groove is positioned between two adjacent ones of the plural spiral groove groups, for flowing the fuel supplied through the fuel supply hole therethrough, each of the spiral grooves and the edge grooves being formed in such a manner as to have a flow sectional area gradually reduced from an inlet to an outlet, and a cylindrical shaped nozzle casing that is upwardly and downwardly opened and adapted to accommodate the nozzle body at a lower portion thereof and the injector at an upper portion thereof, in such a manner that the injector is positioned on the nozzle body and the injection hole of the injector is tightly secured onto the fuel supply hole of the nozzle body.

* * * * *